US006364063B1

(12) United States Patent
Aulanko et al.

(10) Patent No.: US 6,364,063 B1
(45) Date of Patent: Apr. 2, 2002

(54) ELEVATOR ROPE ARRANGEMENT

(75) Inventors: Esko Aulanko, Kerava; Simo Mäkimattila, Espoo, both of (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/337,739

(22) Filed: Jun. 22, 1999

Related U.S. Application Data

(63) Continuation of application No. PCT/FI97/00824, filed on Dec. 30, 1997.

(30) Foreign Application Priority Data

Dec. 30, 1996 (FI) ..... 965242
Dec. 30, 1996 (FI) ..... 965243

(51) Int. Cl.[7] ..... B66B 7/06; B66B 11/08

(52) U.S. Cl. ..... 187/266; 187/251; 187/254; 187/264; 187/265

(58) Field of Search ..... 187/251, 254, 187/266, 264, 265, 262, 250, 252, 411

(56) References Cited

U.S. PATENT DOCUMENTS

| | | | | |
|---|---|---|---|---|
| 657,380 A | | 9/1900 | Baldwin | 187/265 |
| 975,790 A | * | 11/1910 | Pearson | 187/254 |
| 1,011,423 A | * | 12/1911 | Gale, Sr. | 187/264 |
| 1,035,230 A | * | 8/1912 | Pearson | 187/254 |
| 1,071,309 A | * | 8/1913 | Goggin | 187/266 |
| 3,174,585 A | | 3/1965 | Tofanelli | 187/264 |
| 3,910,383 A | * | 10/1975 | Friedl | |
| 4,022,010 A | * | 5/1977 | Glandenbeck et al. | 57/231 |
| 4,227,041 A | * | 10/1980 | Den et al. | 174/117 F |
| 4,445,593 A | | 5/1984 | Coleman et al. | 187/413 |
| 4,624,097 A | * | 11/1986 | Wilcox | 57/232 |
| 4,716,989 A | * | 1/1988 | Coleman et al. | 187/94 |
| 5,149,057 A | * | 9/1992 | Meurer | 254/276 |
| 5,398,781 A | | 3/1995 | Biewald et al. | 187/264 |
| 5,566,783 A | | 10/1996 | Yamashita | 187/266 |

(List continued on next page.)

FOREIGN PATENT DOCUMENTS

| | | | |
|---|---|---|---|
| EP | 0100583 | * | 2/1983 |
| EP | 0179648 | * | 4/1986 |
| EP | 0672781 A1 | | 9/1995 |
| JP | 74020811 | * | 5/1974 |
| JP | 58026515 | * | 2/1983 |
| JP | 61193305 | * | 8/1986 |
| JP | 3001409 | * | 1/1991 |
| JP | 403176912 | * | 7/1991 |
| JP | 404201966 | * | 7/1992 |
| JP | 406044829 | * | 2/1994 |
| JP | 8261972 | * | 10/1996 |
| WO | WO 99/43590 | * | 9/1999 |
| WO | WO 99/43593 | * | 9/1999 |
| WO | WO 99/43595 | * | 9/1999 |
| WO | WO 99/43596 | * | 9/1999 |
| WO | WO 99/43599 | * | 9/1999 |
| WO | WO 99/43600 | * | 9/1999 |
| WO | WO 99/43885 | * | 9/1999 |

*Primary Examiner*—Dean J. Kramer
*Assistant Examiner*—Paul T. Chin
(74) *Attorney, Agent, or Firm*—Birch, Stewart, Kolasch & Birch, LLP

(57) ABSTRACT

Elevator rope arrangement in which the elevator car and counterweight, travelling along guide rails in an elevator shaft, are supported by suspension ropes, which are attached to the top part of the elevator car and passed via at least one diverting pulley to the counterweight. Separate hoisting ropes are attached to the lower part of the elevator car and passed to lower part of the counterweight via at least one diverting pulley. The hoisting rope is a substantially thin rope made of synthetic fiber and having a sheath of plastic material.

20 Claims, 3 Drawing Sheets

U.S. PATENT DOCUMENTS 5,566,786 A 10/1996 De Angelis et al. ..... 187/266
5,881,845 A * 3/1999 O'donnell et al. ..... 187/411
5,931,265 A * 8/1999 Hollowell et al. ..... 187/254
6,138,799 A * 10/2000 Schroder-Brumloop et al. ..... 187/252
6,193,016 B1 * 2/2001 Hollowell et al. ..... 187/251
6,193,018 B1 * 2/2001 Schroder-Brumloop et al. ..... 187/266
6,305,499 B1 * 10/2001 Jones et al. ..... 187/266

* cited by examiner

ELEVATOR ROPE ARRANGEMENT

This application is a continuation of PCT/FI97/00824 filed Dec. 30, 1997.

FIELD OF THE INVENTION

The present invention relates to an elevator rope arrangement.

DESCRIPTION OF THE BACKGROUND ART

In traction sheave elevators, the elevator car and counterweight are suspended on round steel ropes. Normally, the same ropes act both as suspension ropes, whose function is to support the elevator car and counterweight, and as hoisting ropes serving to move the elevator car and counterweight. Therefore, the ropes must be designed to carry the entire load, even if, when a counterweight is used, the force needed to move the elevator is very small—in an extreme case nearly zero when the counterweight and the elevator car with the car load are equal in weight.

In prior art, there are also solutions having separate suspension ropes and hoisting ropes. Such an elevator is presented e.g. in U.S. Pat. No. 5,398,781. In the elevator described in this specification, the suspension rope is attached to the top part of the elevator car and passed via diverting pulleys to a lever element on the counterweight. The hoisting rope is attached either to the top or bottom part of the elevator car and, like the suspension rope, passed via diverting pulleys and the traction sheave of the hoisting machine to a lever element on the counterweight. To compensate for rope elongation, the elevator described in this specification comprises a lever element fitted in conjunction with the counterweight and acting as a tensioning device. This patent focuses especially on the tensioning of the hoisting rope and contains no mention of any details of the suspension ropes or hoisting ropes. Neither does it describe any advantages that could be achieved by separate implementation of hoisting ropes and suspension ropes.

The hoisting ropes generally used are steel cables, whose friction coefficient is, however, so low that it has to be increased e.g. by using traction sheaves with different types of grooves or by increasing the angle of contact or angle of rotation of the rope around the traction sheave. In addition, a hoisting rope made of steel functions as a kind of sound bridge between the hoisting motor drive and the elevator car, transmitting noise from the hoisting machinery to the elevator car and thus impairing passenger comfort.

A further drawback with prior-art solutions using steel hoisting ropes is that the bending radius of the rope is relatively large, which means that the traction sheave and diverting pulleys must have a large diameter. Another drawback with steel rope is that the weight of the rope imposes a limit on the hoisting height of elevators. Moreover, steel ropes are liable to corrosion, so they require regular maintenance.

Specification EP 672 781 A1 presents a round elevator suspension rope made of synthetic fibers. Topmost on the outside it has a sheath layer surrounding the outermost strand layer. The sheath layer is made of plastic, e.g. polyurethane. The strands are formed from aramid fibers. Each strand is treated with am impregnating agent to protect the fibers. Placed between the outermost and the inner strand layers is an intermediate sheath to reduce friction. To achieve a nearly circular strand layer and to increase the volumetric efficiency, the gaps are filled with backfill strands. The function of the top-most sheath layer is to ensure a coefficient of friction of desired magnitude on the traction sheave and to protect the strands against mechanical and chemical damage and UV radiation. Thus, the load is supported exclusively by the strands. As compared with corresponding steel rope, a rope formed from aramid fibers has a substantially larger load bearing capacity and a specific weight equal to only a fifth or a sixth of the specific weight of corresponding steel rope.

A drawback with these prior-art solutions, in which a round elevator rope formed e.g. from synthetic fibers, is that the rope has a relatively large bending radius, requiring the use of large-diameter traction sheaves and diverting pulleys. Further, there occurs a fair deal of sliding of the strands and fibers in relation to each other. Moreover, the ratio of volume to area is high, which means that frictional heat will not be effectively removed from the rope and the rope temperature is therefore liable to rise unduly.

SUMMARY OF THE INVENTION

The object of the present invention is to eliminate the drawbacks of prior art and achieve a new type of elevator rope arrangement, in which the elevator ropes are divided into two categories: a) suspension ropes, whose function is to connect the elevator car and the counterweight to each other and to support them, and b) a new type of hoisting rope made of synthetic material, whose function is to receive the unbalance between the counterweight on the one hand and the elevator car and its load on the other hand and to move the elevator car.

In this arrangement, friction is not a necessary consideration regarding the suspension ropes, so these can be made of steel cable. contrast, the hoisting ropes are thin ropes of synthetic material, in which the tensile strength of the structure is formed by longitudinal strands of e.g. aramid fiber. These strands are surrounded by a sheath that binds the strands of each rope together and provides a good friction coefficient against the traction sheave. The sheath is made of e.g. polyurethane, which gives a multifold friction coefficient as compared e.g. with steel rope. Details of the features characteristic of the solution of the invention are given below.

The hoisting ropes now only have to bear a fraction of the loads of the elevator, as they need not support the load resulting from the passengers or goods being transported and the counterweight. Therefore, the elevator hoisting rope of the invention can be made very thin, which means that it has a small bending diameter. The hoisting rope can also be implemented as a flat rope, in which case the sheath of the hoisting rope is of a planar shape and, in cross-section, the hoisting rope thus has a width substantially larger than its thickness.

The thin and flat hoisting rope allows the use of a traction sheave that is considerably smaller in diameter and lighter than those used at present. Therefore, also the moment required for moving the elevator car is low, and consequently it is possible to use a small and cheap hoisting motor. The flat band-like shape of the rope distributes the pressure imposed by the rope on the traction sheave or diverting pulley more uniformly on the surface of the traction sheave. Further, sliding of the fibers relative to each other is minimised, and so the internal shear forces in the rope are also minimised. In addition, the ratio of volume to area is low, which means that frictional heat is effectively transmitted from the rope to the environment. Furthermore, the sheath of the hoisting rope can easily be coated with various materials, so the friction and abrasion characteristics can be optimised for different traction sheave materials. The small motor and small traction sheave are well applicable to an elevator without machine room because the hoisting motor with the traction sheave can be easily accommodated in the elevator shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by the aid of an example by referring to the attached drawings which are given by way of illustration only, and thus are not limitative of the present invention, and in which.

DETAILED DESCRIPTION OF THE PREFERRED EMBODIMENTS

Figure 1:
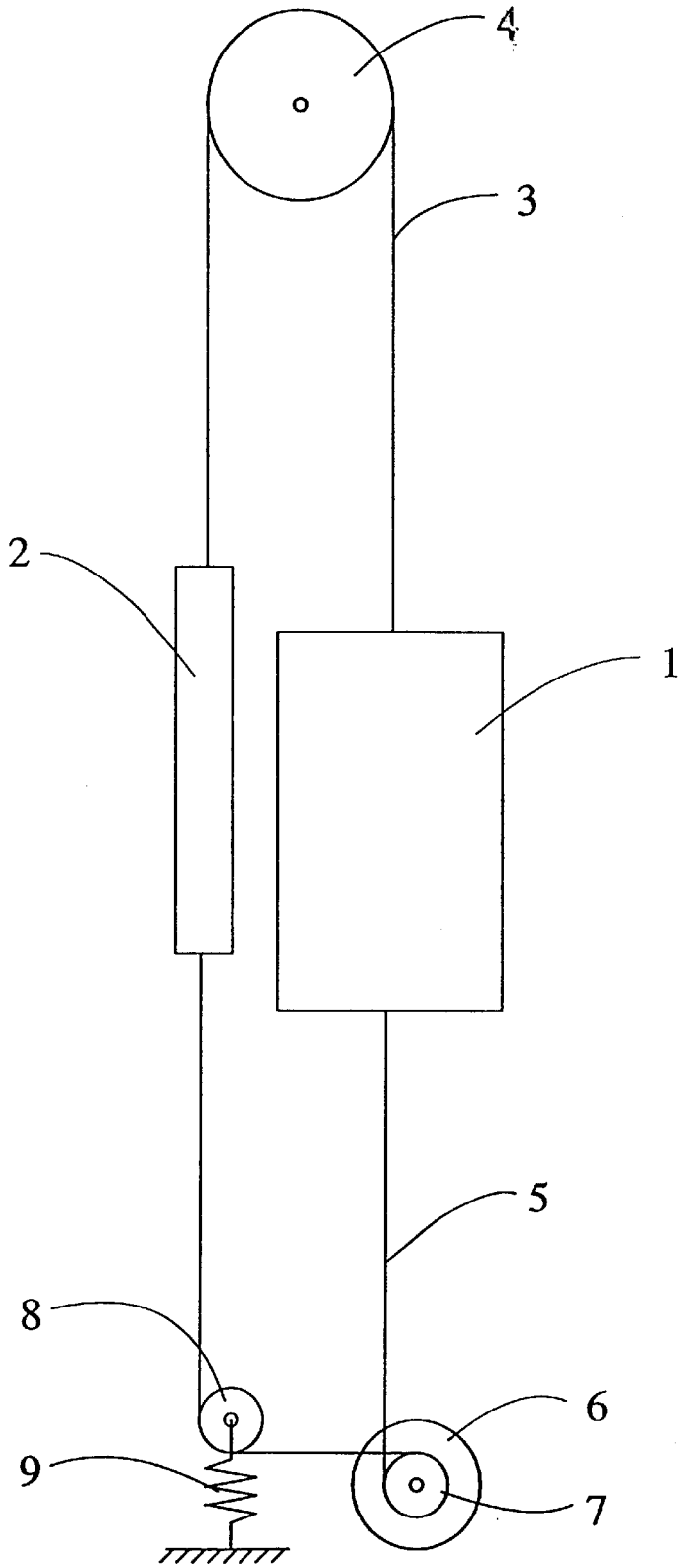
FIG. 1 presents an elevator rope arrangement according to the invention.

FIG. 1 shows a traction sheave elevator according to the invention, comprising an elevator car 1 and a counterweight 2 travelling along guide rails in an elevator shaft and suspended on suspension ropes 3. The, steel suspension ropes 3 are fixed to the top part of the elevator car 1 and passed via a diverting pulley 4 in the elevator shaft to the counterweight 2. The substantially round hoisting ropes 5 used to move the elevator car and counterweight, made of synthetic material, are flexible and substantially thin as compared with the suspension ropes. The hoisting ropes are attached by their first end to the lower part of the elevator car 1, from where the ropes are passed to the lower part of the counterweight 2 via the traction sheave 7 of a drive machine 6 placed on the bottom of the elevator shaft below the elevator car 1 and via a diverting pulley 8 placed on the bottom of the elevator shaft below the counterweight. The drive machine is e.g. a discoid electric motor of a flat construction in relation to its diameter, with a traction sheave integrated with the rotor and having a stator and rotor whose diameter is larger than the diameter of the traction sheave. The drive machine can be mounted either on the bottom of the shaft or on the shaft wall structures in the lower part of the elevator shaft. Several hoisting ropes running side by side can be used. In the solution illustrated by FIG. 1, the friction between the hoisting ropes and the traction sheave has been increased by having the hoisting ropes pass around the traction sheave 7 so that the hoisting ropes coming down from the elevator car pass between the diverting pulley 8 and the traction sheave 7 down to the traction sheave, run around the traction sheave by its lower side and then, having passed through a partial round about the traction sheave, go further by its upper side and intersect themselves, and after the intersection they go further to the diverting pulley 8, pass the diverting pulley by its lower side and go up to the counterweight. In this embodiment, the hoisting ropes are attached to the lower part of the counterweight.

In thins suspension example, several thin hoisting ropes are used, but it is also possible to use a single flat rope. In the case of a flat rope, an additional difficulty results from the rope intersecting itself because the rope has a relatively large width. However, the rope intersection can be implemented either by turning the traction sheave through an appropriate angle about its plane of rotation or by tilting the traction sheave in its plane of rotation. A further possibility is to both turn the traction sheave and tilt it as described above, in which case the angle of turn or the angle of tilt will be smaller than when the traction sheave is only turned or only tilted. When separate hoisting ropes are used, the traction sheave also has to be tilted and/or turned to allow the ropes to cross each other.

The hoisting ropes are tensioned between the elevator car and the counterweight by means of the diverting pulley 8. The tensioning is implemented using a tension spring 9, which draws the traction sheave 8 so that the hoisting ropes always remain sufficiently tight on the traction sheave to provide the required friction regardless of elongation of the hoisting ropes. The tensioning can also be implemented using an arrangement in conjunction with the hoisting machinery, in which case the diverting pulley is fixedly mounted. In this case, the mass of the hoisting machinery can be utilised for the tensioning of the hoisting rope. The hoisting machinery is supported e.g. on the vertical guide rails in the elevator shaft and so connected that its mass will assist the rope tensioning elements.

Figure 2:
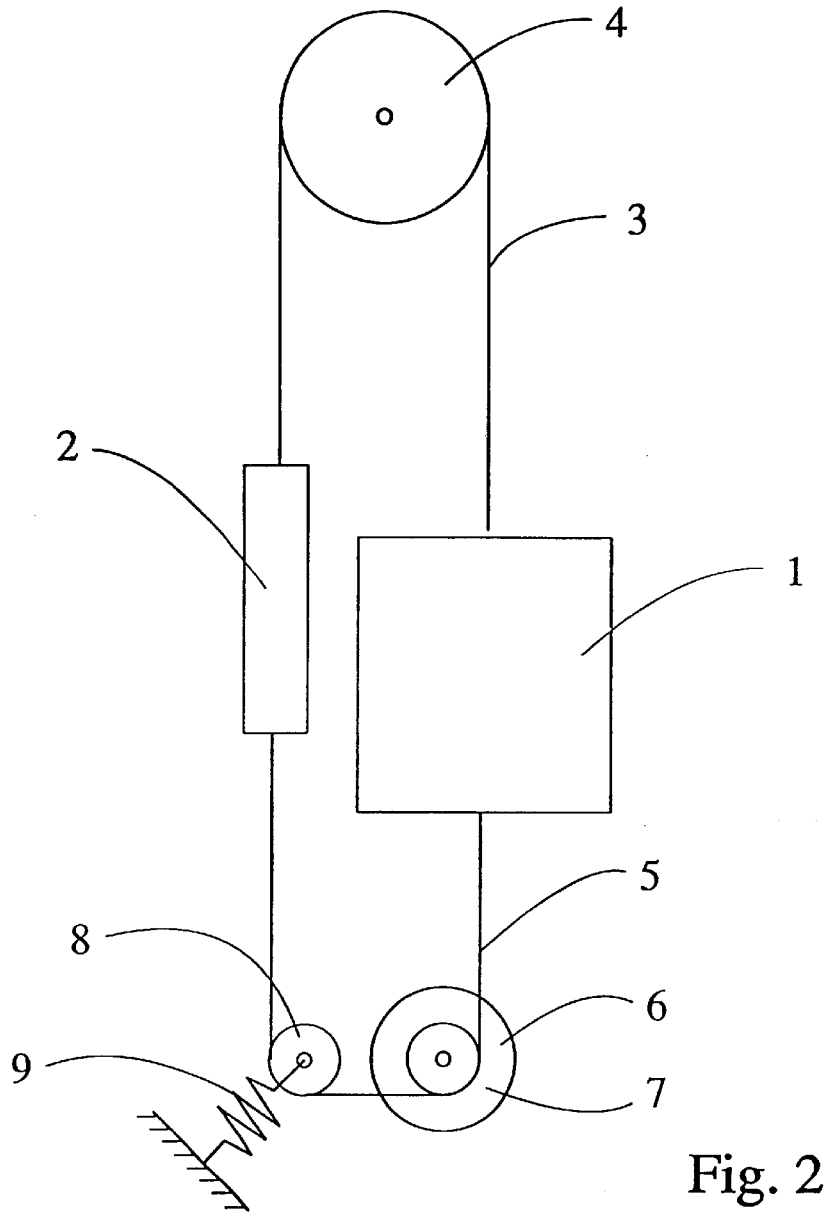
FIG. 2 presents another elevator rope arrangement according to the invention.

FIG. 2 presents a suspension arrangement that is better suited for a flat hoisting rope than the arrangement in FIG. 1 because the hoisting rope does not intersect itself. The hoisting ropes are suspended in the same way as in the solution presented in FIG. 1. Each hoisting rope 5 is attached by its first end to the lower part of the elevator car 1, from where the ropes are passed to the lower part of the counterweight 2 via the traction sheave 7 of a drive machine 6 placed on the bottom of the elevator shaft below the elevator car 1 and via a diverting pulley 8 placed on the bottom of the elevator shaft below the counterweight. The hoisting ropes are implemented in the same way as in FIG. 1, consisting of either a number of separate adjacent ropes or a single flat rope. The hoisting ropes descending from the elevator car go down to the traction sheave 7 by its back side as seen from the direction of the diverting pulley 8, pass around the traction sheave by its lower side and go further to the diverting pulley 8, pass around it by its lower side and go up to the counterweight. In this suspension model, however, the angle of contact between the hoisting rope and the traction sheave is substantially smaller than in the solution presented in FIG. 1, in which it may be as large as over 270°. Therefore, the friction is also smaller, so the rope must be more tightly tensioned than in the case illustrated by FIG. 1. In other respects, the tensioning is implemented in the same way as in FIG. 1.

FIGS. 3–6 present hoisting rope structures in which the load-bearing fibers are in strands. The strand layout is free and can be implemented either according to load capacity requirements or according to bending capacity, e.g. torsional rigidity.

Figure 3:
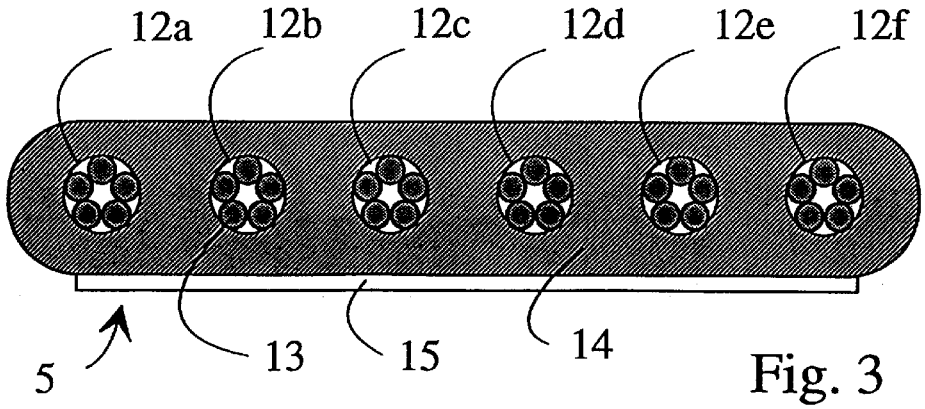
FIG. 3 presents a hoisting rope applicable to the elevator arrangement of the invention.

FIG. 3 presents a substantially flat elevator hoisting rope 5 as used in the suspension arrangement of the invention. It comprises six bundles 12*a*–12*e* of strands fitted in the same plane. The bundles consist of load-bearing strands 13. These longitudinal strands, which form the strength of the rope structure, are made of synthetic fibers, e.g. aramid fibers. The strands are enclosed in a sheath 14 that binds the strands together into a single structure and gives a good friction coefficient in contact with the traction sheave. The bundles 12*a*–12*f* are fitted side by side to form a planar sheath 14, so that the width of the rope is considerably larger than its thickness. The sheath material 14 may be e.g. polyurethane, which gives a multifold friction coefficient as compared with a steel rope. If necessary, the planar surface of the sheath can be coated with various materials. The properties of the coating 15 regarding friction and wear can be optimised for different traction sheave materials. In FIG. 2, the bundles of strands are of a round shape in cross-section, but naturally, the shape can be chosen in accordance with the use.

Figure 4:
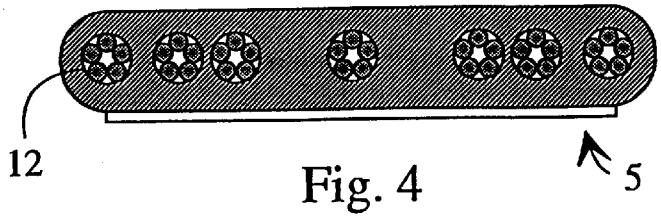
FIGS. 4–8 present different synthetic-fiber rope solutions.
Figure 5:
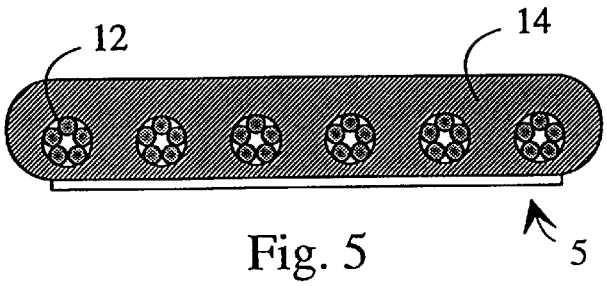
Figure 6:
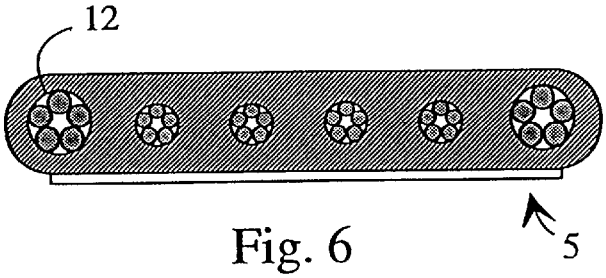

FIG. 4 presents a flat hoisting rope solution in which the bundles 12 of strands are placed at different distances from each other. The Bundles are somewhat closer to each other near the edges than in the middle part of the hoisting rope. In the solution presented in FIG. 5, the bundles 12 of strands are placed non-symmetrically with respect to the longer midline of the hoisting rope, close to the friction surface of the rope. FIG. 6 presents a solution in which the strands and bundles 12 of strands of the hoisting rope are of different sizes in diameter. The larger bundles are placed at the edges of the rope as seen in its widthways direction, with smaller bundles placed between them. In the ways illustrated by FIGS. 4–6, it is possible to improve the tracking of the hoisting rope 5 as it is passing over the traction sheave or diverting pulleys.

Figure 7:
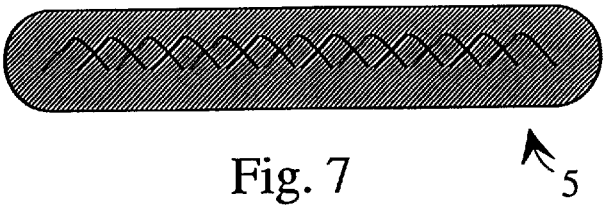
Figure 8:
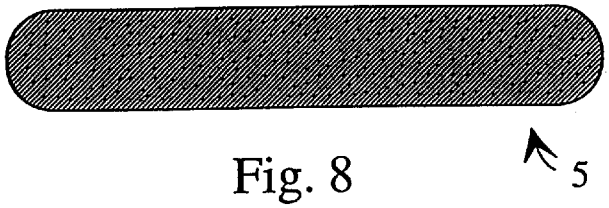

FIGS. 7 and 8 present hoisting rope solutions in which the load-bearing fibers are in the form of a fabric. In the solution illustrated by FIG. 7, the fibers form in the cross-section of the hoisting rope 5 lines crossing each other in both the longitudinal and lateral directions of the hoisting rope 5. The lines may also be in a position oblique to the longitudinal direction of the hoisting rope. Thus, the fabric may resemble e.g. the clinch-built, cross-ply structure of a car's safety belt or a corresponding belt. FIG. 8 presents a hoisting rope structure in which the hoisting rope in its entire cross-sectional area consists of fabric or fabrics bound together by a binding agent, e.g. polyurethane. By using different reinforcing fabrics, it is possible to produce a flexible hoisting rope or suspension rope in which the contacts between individual fibers can be increased or reduced as necessary.

The advantages achieved by using rope solutions as illustrated by FIGS. 3–8 include the following:

- When a single flat hoisting rope is used, the void space between ropes that is involved in the case of separate ropes is avoided, and thus the traction sheave can be made narrower than before.
- The cross-sectional area of the load-bearing part of the rope can be optimised.
- A good degree of damping of rope vibrations is achieved because the separate ropes are now replaced with bundles of strands embedded in a mass of vibration damping material.

When a thin, band-like hoisting rope is used, it is necessary to make sure that lateral drift of the hoisting rope off the traction sheave or diverting pulley is prevented. This can be done in various ways. In one solution, the traction sheave is provided with a tilting mechanism and sensors monitoring the position of the rope edge. The traction sheave is a straight cylinder, whose axis of rotation can be tilted to bring the hoisting rope to the central part of the traction sheave. When the hoisting rope is drifted to the edge of the traction sheave, a mechanical sensor or an equivalent detector based on beam of light or the like gives a corresponding signal to the system controlling the tilting of the traction sheave, whereupon the tilt of the traction sheave is altered so that the band-like hoisting rope is brought back to the middle of the traction sheave. If necessary, it is possible to use a cambered/crowned traction sheave or diverting pulley, i.e. one with a varying diameter, in which case the circumferential surface of the sheave/pulley is either convex or concave as seen from the front of the sheave/pulley. The advantage achieved is a good retention of the hoisting rope in its proper position.

When thin separate hoisting ropes are used, the bundles 12*a*–12*f* of strands are placed apart from each other, in which case they function like independent hoisting ropes regardless of the other bundles.

As stated above, when the hoisting rope structure of the invention is used, the traction sheaves needed e.g. in the elevator suspension arrangements described above are considerably smaller in diameter and lighter than the traction sheaves currently used. The smaller traction sheave and machinery allow all elevator components to be accommodated in the elevator shaft, thus eliminating the need for a separate machine room. This brings considerable savings in the delivery price of the elevator.

It is obvious to a person skilled in the art that different embodiments of the invention are not restricted to the example described above, but that they may be varied in the scope of the claims presented below. Thus, the elevator hoisting rope need not necessarily have a round or flat cross-sectional form. Instead, it may be e.g. a triangular-belt type rope having a V-shaped cross-section, in which case it is possible to achieve a very large friction between each hoisting rope and the corresponding keyway on the traction sheave. The suspension ropes can also be made of synthetic fibers and they may include either several adjacent ropes or only one flat rope. In addition, the bundles of strands can be arranged in more than one layer, e.g. in two layers, if necessary in view of the load to be borne by the rope. The suspension ratio may also be other than the 1:1 suspension presented in the example.

What is claimed is:

1. An elevator rope arrangement for an elevator having an elevator car and a counterweight, the elevator car being movable along a guide rail in an elevator shaft, a drive machine with a traction sheave being provided to drive the elevator, the arrangement comprising:

suspension ropes attached to a top part of the elevator car and passed via at least one diverting pulley to the counterweight;

at least one hoisting rope attached to the elevator car and passed from the elevator car to the counterweight via the traction sheave of the drive machine and via at least one diverting pulley, the hoisting rope being at least one substantially thin rope made of synthetic fibers, the at least one hoisting rope being covered with a sheath, the at least one hoisting rope having a flat shape in cross section; and a rope tensioning device arranged in a lower part of the elevator shaft for tensioning the at least one hoisting rope, the rope tensioning device including a spring for keeping the at least one hoisting rope in tension.

2. The elevator rope arrangement as defined in claim 1, wherein the synthetic fibers of the at least one hoisting rope are made from aramid fibers.

3. The elevator rope arrangement as defined in claim 2, wherein the sheath covering the at least one thin rope is made of polyurethane.

4. The elevator rope arrangement as defined in claim 1, wherein the sheath covering the at least one thin rope is made of plastic material.

5. The elevator rope arrangement as defined in claim 4, wherein the plastic material of the sheath is polyurethane.

6. The elevator rope arrangement as defined in claim 1, wherein the at least one hoisting rope includes a plurality of thin ropes made of synthetic fibers which are each covered with a sheath.

7. The elevator rope arrangement as defined in claim 6, wherein each of the plurality of thin ropes are made from aramid fibers.

8. The elevator rope arrangement as defined in claim 7, wherein the sheath is made of plastic material.

9. The elevator rope arrangement as defined in claim 8, wherein the plastic material of the sheath is polyurethane.

10. The elevator rope arrangement as defined in claim 1, wherein the plurality of thin ropes are coplanar.

11. The elevator rope arrangement as defined in claim 1, wherein the plurality of thin ropes are fitted side-by-side in at least one plane to form a layer of bundles of strands so that in cross-section the rope is substantially larger in width than in thickness.

12. The elevator rope arrangement as defined in claim 11, wherein each of the plurality of thin ropes are made from aramid fibers.

13. The elevator rope arrangement as defined in claim 6, wherein the plurality of thin ropes have an open space between each rope and are arranged in at least one plane.

14. The elevator rope arrangement as defined in claim 13, wherein at least some of the plurality of thin ropes pass through a space which is adjacent thereto such that the hoisting ropes are intertwined.

15. The elevator rope arrangement as defined in claim 14, wherein the hoisting ropes encircle the traction sheave of the drive machine.

16. The elevator rope arrangement as defined in claim 6, wherein the hoisting ropes encircle the traction sheave of the drive machine.

17. The elevator rope arrangement as defined in claim 6, wherein the plurality of thin ropes are in bundles of strands and the bundles are separate from other bundles so that each of the bundles functions as an independent rope.

18. The elevator rope arrangement as defined in claim 1, wherein the at least one hoisting rope encircles the traction sheave of the drive machine.

19. The elevator rope arrangement as defined in claim 1, wherein an end of the suspension rope is attached to the elevator car.

20. The elevator rope arrangement as defined in claim 1, wherein all of the ropes of the at least one hoisting rope are together in a bundle with a cross-section of the rope being substantially larger in width than in thickness and wherein an outer surface of the bundle smooth and substantially flat without any uniform undulations thereon.

* * * * *

UNITED STATES PATENT AND TRADEMARK OFFICE

CERTIFICATE OF CORRECTION

PATENT NO. : 6,364,063 B1
DATED : April 2, 2002
INVENTOR(S) : Esko Aulanko et al.

It is certified that error appears in the above-identified patent and that said Letters Patent is hereby corrected as shown below:

Title page,
Item [63], Related U.S. Application Data, please change "Continuation of application No. PCT/FI97/00824, filed on Dec. 30, 1997" to -- Continuation of application No. PCT/FI97/00824, filed on Dec. 19, 1997 --.

Signed and Sealed this

Twenty-fourth Day of September, 2002

*Attest:*

*Attesting Officer*

JAMES E. ROGAN
*Director of the United States Patent and Trademark Office*